US005207402A

United States Patent [19]

Berry-Tremmel et al.

[11] Patent Number: 5,207,402

[45] Date of Patent: May 4, 1993

[54] SUPPORT FRAME FOR A SIGN

[76] Inventors: Pamela Berry-Tremmel; Victoria Wallerius, both of 14351 Torrey Chase #E, Houston, Tex. 77014

[21] Appl. No.: 760,179

[22] Filed: Sep. 16, 1991

[51] Int. Cl.[5] ..... A45F 3/44

[52] U.S. Cl. ..... 248/156; 40/606; 40/607

[58] Field of Search ..... 248/156, 545; 40/606, 40/607, 611; 52/156; 299/87; 175/394

[56] References Cited

U.S. PATENT DOCUMENTS

| | | | |
|---|---|---|---|
| 1,439,982 | 12/1922 | Shrauger | 40/607 |
| 2,799,369 | 7/1957 | Walton | 52/156 X |
| 3,058,246 | 10/1962 | Schoeffler | 40/607 |
| 3,284,039 | 11/1966 | Brunner | 248/156 X |
| 4,254,597 | 3/1981 | Feldman et al. | 52/156 X |
| 4,910,902 | 3/1990 | Anderson | 248/545 X |
| 4,916,840 | 4/1990 | Getz | 40/611 X |

*Primary Examiner*—Blair M. Johnson
*Attorney, Agent, or Firm*—Harrison & Egbert

[57] ABSTRACT

A sign frame having a ground insertion member with a generally pointed end and a spiralled surface formed thereon, a plate affixed to the end of the ground insertion member opposite the pointed end, a first sign support member extending angularly upwardly and outwardly from a side of the plate opposite the ground insertion member, and a second sign support member extending angularly upwardly and outwardly from the side of the plate opposite the ground insertion member. A sign receiving section is connected to the first and second sign support members for receiving a flat sign therein. The ground insertion member is a cylindrical member. The spiralled surface extends for approximately five hundred and forty degrees around the exterior of the cylindrical member between the plate and the pointed end. The pointed end is a triangular member having an end surface with a length greater than the diameter of the cylindrical member. A crossbar extends between the first and second sign support members generally parallel to the plate.

16 Claims, 1 Drawing Sheet

SUPPORT FRAME FOR A SIGN

TECHNICAL FIELD

The present invention relates generally to sign frames. More particularly, the present invention relates to sign frames which include apparatus for fastening the sign to the ground.

BACKGROUND ART

Certain businesses, particularly real estate brokers, need temporary signs to advise potential customers that a particular property is for sale. Large tracts of undeveloped land often warrant the expense of a permanent sign; however, this is seldom true of residential property. The result is that most real estate brokers, rental agents, and the like, use temporary metal signs that they can merely stick into the ground and leave on display until such time as the property is sold, they lose their listing, or when the property is taken off the market.

While such signs are temporary in the sense that they remain in a given location only for a limited period of time, they are by no means inexpensive. Even small signs cost twenty-five dollars or more, depending on the quality of the sign. A particular broker will own anywhere from a few of these signs to several hundred depending upon the size of the organization, the number of properties it has listed the geographical areas in which its sales people work, etc. Regardless of the size of the organization, theft becomes a very real problem both because of the cost of replacing the sign itself and also because of the time and effort it takes to set one up again. In the meantime, of course, the broker's message is not to be seen but, most importantly, the homeowner's property is, to some extent at least, off the market.

Real estate signs come in two general types, the single post version and the double post version. In both of these versions, the sign is merely stuck or hammered into the ground on the lawn in front of the listed property. Vandals and pranksters find that it takes but a few seconds to remove one and to haul it away in a waiting vehicle. In addition, the manner of installation often requires hammering so as to secure the sign within the earth. Such hammering tends to damage the flexible fragile frame which retains the sign. As a result, the sign will eventually deteriorate to where it presents a very unprofessional damaged appearance.

Additionally, many real estate brokers lack the necessary strength so as to effectively install the sign into the ground. In instances where the ground is very hard, the real estate brokers may be unable to effectively install the sign into the ground. As a result, the sign will become dislodged, fall over, or otherwise improperly placed. It is important to provide a real estate sign that can be easily installed by persons without great strength. It is also important to be able to install the sign without additional installation equipment, such as hammers, post diggers, or shovels.

The problems stated hereinbefore could be largely eliminated if one could come up with a simple way of anchoring such signs in the ground. Since they are not worth a major effort to remove, the prankster who is responsible for stealing or dislodging such signs is rather easily discouraged. An inexpensive, yet easily anchored sign is an excellent product for real estate brokers and others having problems with the theft of temporary signs. Additionally, the signs should be able to have the necessary equipment for self-installation.

Various U.S. patents have issued in the past which attempt to address these problems. U.S. Pat. No. 2,584,713, issued on Feb. 5, 1952, to S. W. Kanaval describes a sign supporting structure which includes a sign frame having a plurality of legs. One of the legs is interconnected into a tubular member which has an auger at the end. The auger can be rotatably inserted into the ground so that the sign can be rigidly supported above the ground. U.S. Pat. No. 3,317,168, issued on May 2, 1967, to G. R. Ziph shows an object-supporting standard and ground anchor. In particular, this patent describes an enlarged ground-engaging foot which is secured to the lower end of the standard. A heavy helical spring is secured at its upper end to the standard in spaced relation above the ground and extends downwardly below the foot. This spring can be used to enter the ground in the manner of a corkscrew so as to draw the foot into abutment with the ground. U.S. Pat. No. 4,130,957, issued on Dec. 26, 1978, to M. D. Hampton shows a theft-proof real estate sign of the type which is stuck into the ground. One of the posts is formed into a corkscrew and is screwed into the ground. The other post is eliminated and replaced by a corkscrew stake chain locked, or otherwise detachably fastened, to the sign frame. U.S. Pat. No. 4,524,533, issued on Jun. 25, 1985, to S. A. Still, Jr. shows a realtor sign system which can be separated into components that can be easily carried in an automobile trunk or back seat compartment. A frame is provided which has a pointed spike in the ground-engaging portion of the frame. An abutment surface is positioned above the spike so as to rest on the ground when the sign is installed. U.S. Pat. No. 4,863,137, issued on Sep. 5, 1989, to Cockman et al. describes a post anchor, for anchoring a post in soil, which has an elongated shank having a boring end and a bracket end. An auger is carried near the boring end of the shank for boring a hole in the soil. A compactor plate is provided adjacent to the bracket end. U.S. Pat. No. 4,923,165, issued on May 8, 1990, to B. R. Cockman shows a similar type of post anchor.

It is an object of the present invention to provide a sign frame that allows the sign to be easily installed into the ground.

It is another object of the present invention to provide a sign frame that, once installed, discourages theft and easy removal.

It is another object of the present invention to provide a sign frame that is relatively inexpensive to manufacture.

It is a further object of the present invention to provide a sign frame that can be rigidly braced against the surface of the ground.

These and other objects and advantages of the present invention will become apparent from a reading of the attached specification and appended claims.

SUMMARY OF THE INVENTION

The present invention is a sign frame that comprises a ground insertion member having a generally pointed end and a spiralled surface thereon, a plate affixed to an end of the ground insertion member opposite the pointed end, a first sign support member extending angularly upwardly and outwardly from a side of the plate opposite the ground insertion member, a second sign support member extending angularly upwardly and outwardly from the opposite side of the plate from the ground insertion member, and a sign receiving section connected to the first and second sign support members for receiving a flat sign therein.

The ground insertion member is a longitudinal cylindrical member. The spiralled surface is affixed to the cylindrical member between the pointed end and the plate. This spiralled surface extends for roughly five hundred and forty degrees (540°) around an exterior of the cylindrical member. The pointed end can be a solid triangular (arrowhead-shaped) member which is fastened to the cylindrical member. The end surface of the pointed end has a length which is greater than the diameter of the cylindrical member. The plate extends perpendicularly to this cylindrical member. The cylindrical member is affixed generally to a central location on a surface of the plate.

The first and second sign support members are affixed to opposite ends of the plate. The first and second sign support members extend outwardly from the plate in opposite directions. The sign receiving section has a generally rectangular shape. The first and second sign support members form the sides of this rectangular shape. The rectangular shape has a slot therein for removably receiving the flat sign. The sign receiving section also has a crossbar which extends between and is connected to the first and second sign support members. This crossbar is arranged generally parallel to the plate. The crossbar has at least one bracket therein for supporting another sign below the crossbar.

DETAILED DESCRIPTION OF THE INVENTION

Figure 1:
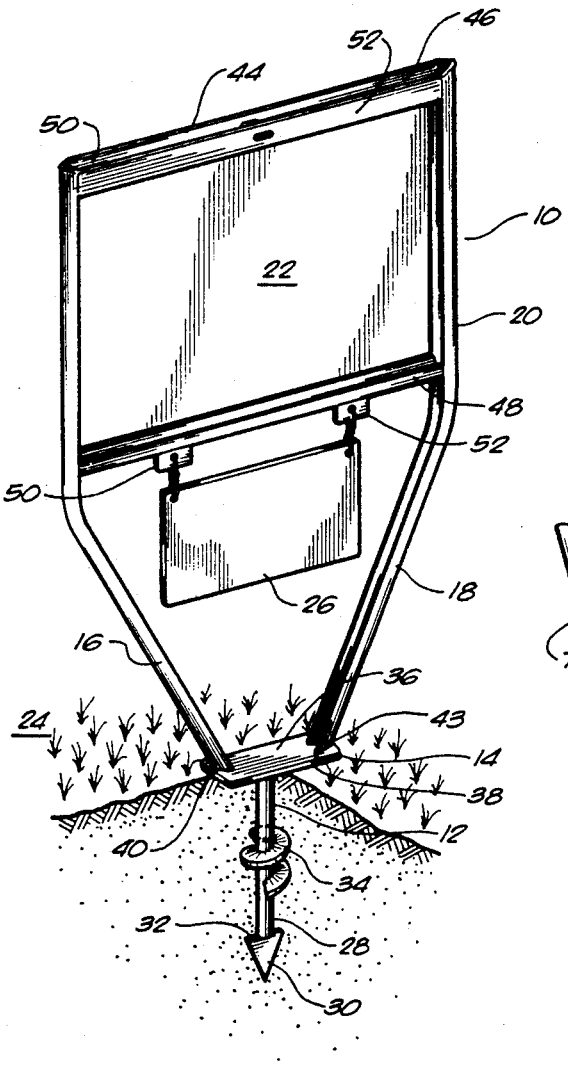
FIG. 1 is a perspective view of the sign frame in accordance with the preferred embodiment of the present invention.

Referring to FIG. 1, there is shown at 10, the sign frame in accordance with the preferred embodiment of the present invention. As can be seen, sign frame 10 comprises ground insertion member 12, plate 14, first sign support member 16, second sign support member 18, and sign receiving section 20. Each of these elements is configured so as to support sign 22 in a suitable position above ground 24. It is also arranged so as to support a secondary sign 26 therebelow and above the ground 24.

The ground insertion member 12 comprises a generally cylindrical member 28 which has a generally pointed end 30. Cylindrical member 28 is a longitudinal member that extends from plate 14 to the pointed end 30. In its normal configuration, the cylindrical member 28 can be a tube, a solid cylinder, or formed in another fashion so as to extend properly through the earth 24.

The pointed end 30 is a solid triangular member that has its broad end 32 affixed to the end of cylindrical member 28. The broad end 32 has a wider diameter than the diameter of the cylindrical member 28. In this configuration, the broad end 32 of triangular member 30 will provide resistance to the movement of the cylindrical member 28 upward through the earth 24. It should also be noted that the pointed end 30 could also be a conical member which is affixed to the end of cylindrical member 28. A cone 30 should also have an end surface with a diameter greater than the diameter of the cylindrical member 28. It is important to the concept of the present invention that the end surface 32 of the pointed end 30 have a length which is wider than the diameter of the cylindrical member 28 so as to present the proper resistance to the removal of the sign frame 10 from the earth 24.

A spiralled surface 34 is affixed to the exterior of cylindrical member 28 between the pointed end 30 and the plate 14. Ideally, the spiralled surface 34 should be positioned midway between the pointed end 30 and the plate 14. The spiralled surface extends for a turn and a half (or five hundred and forty degrees) around the cylindrical member 28. The arrangement of the spiralled surface 34, in its configuration around the cylindrical member 28 allows the ground insertion member 12 to be properly driven into the ground. The continual rotation of the spiralled surface 34 allows the insertion member 12 to go deeper into the earth 24 as the sign frame 10 is continually rotated. It has been found that it is not necessary to extend the spiralled surface 34 from the pointed end 30 to the plate 14. The inclusion of the spiralled surface 34 in the central location along the longitudinal cylindrical member 28 serves the purposes of the present invention. Additionally, the spiralled surface 34 has an outer diameter which is greater than the length of the end surface 32 of the triangular member 30. As such, the spiralled surface S4 provides an additional resistance surface against the movement of the frame 10 upwardly from the earth 24. The sign frame 10 cannot be easily pulled from the earth 24.

Plate 14 is a flat rigid member which is affixed, on one side, to the ground insertion member 12. The cylindrical member 12 is fastened generally in the central area 36 of the plate 14. When the ground insertion member 12 is installed into the earth 24, the bottom side 38 of plate 14 will abut the surface of the earth 24. As such, the plate 14 provides stability for the sign frame 10 against wind or other movement. It is important to the configuration of the present invention to provide a rigid broad earth abutment surface. In combination with the arrangement of the spiralled surface 34 and the triangular plate 30, the plate 14 prevents easy removal of the sign frame 10 by moving the sign frame 10 back and forth. The plate 14 provides additional resistance against the manipulation of the sign 10 for the purpose of removing the sign from the ground 24.

The first sign support member 16 extends angularly upwardly and outwardly from side 40 of plate 14. The second sign support member 18 extends angularly upwardly and outwardly from the other side 43 of the plate 14. As can be seen, the first sign support member 16 and the second sign support member 18 are affixed to opposite ends 40 and 43 of the plate 14. It can also be seen that the sign support members 16 and 18 extend outwardly in opposite directions from the plate 14. In the configuration illustrated, the attachment of the sign support members 16 and 18 to the opposite ends 40 and 43 of plate member 14 enhance the ability to support the sign 22 and to enhance the ability to insert the sign frame 10 into earth 24. By locating the sign support members 16 and 18 at the opposite ends of the plate 14, additional leverage is provided to the user of the sign so as to enable the user of the sign to properly insert and rotate the sign for placement purposes. The arrangement also provides for a broader support base for the structure of the sign frame 10. The sign receiving section 20 has a generally rectangular configuration. In particular, the sign receiving section 20 is made up of vertical portions of the first sign support member 16 and the second sign support member 18. A top crossbar 44 is provided having a slot 46 formed therein. Slot 46 receives the sign 22 in slidable fashion. A bottom crossbar 48 extends between the first sign support member 16 and the second sign support member 18. The bottom crossbar 48 includes brackets 50 and 52 for the purpose of supporting the secondary sign 26 below the second crossbar 48. As shown in FIG. 1, the brackets 50 and 52 have holes therein for receiving a chain affixed to the "sold" sign 26. The brackets 50 and 52 on crossbar 48 provide an easy technique for the installation and/or replacement of the sign 26 depending upon the condition of the real estate to which the sign frame 10 is attached. The bottom crossbar 48 also provides additional structural support for the sign frame 10 of the present invention. The sign 22 will have its bottom edge abutting the bottom crossbar 48. Suitable locking means can be included into the top crossbar 44 so as to secure the sign 22 within the slotted area between the first sign support member 16 and the second sign support member 18.

In FIG. 1, it can be further seen that the sign support members 16 and 18 are V-shaped members. These V-shaped members provide, at their corners, a receiving area for the sign 22. Additionally, the structure of the V-shaped members enhances the structural integrity of the sign frame 10 of the present invention. The top crossbar 44 includes a first strut 50 which extends between one edge of each of the support members 16 and 18 and a second strut 52 which extends between another edge of the V-shaped support members 16 and 18. This arrangement provides additional structural integrity to the sign frame.

Figure 2:
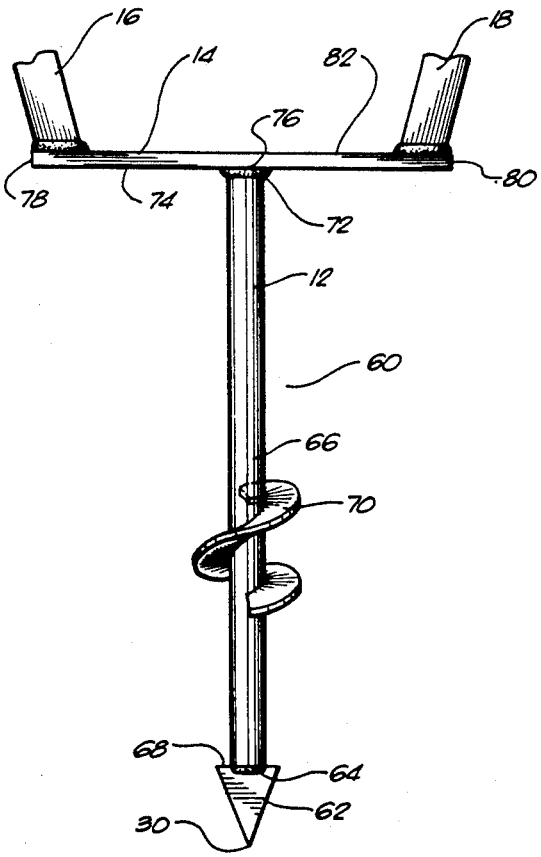
FIG. 2 is a side elevational view of the support frame in accordance with the preferred embodiment of the present invention.

FIG. 2 shows the apparatus 60 for supporting a structure above the ground. In particular, the apparatus 60 has the configuration of the ground insertion member 12, the plate 14, and the support members 16 and 18. As can be seen, a triangular member 62 is rigidly fastened to the end 64 of the cylindrical member 66. The triangular member 62 has an end surface 68 which is wider than the diameter of cylindrical member 66. The triangular member 62 can be fastened to the end 64 of cylindrical member 66 by welding or by integrally forming it with the cylindrical member 66.

The spiralled surface 70 is rigidly affixed to the exterior of cylindrical member 66. Spiralled surface 70 is generally wider than the end surface 68 of triangular member 62. It can be seen that the spiralled surface 70 extends for a turn and a half (or five hundred and forty degrees).

The end 72 of cylindrical member 66 is fastened to the bottom side 74 of plate 14 by an appropriate weld 76. Plate 14 has first support member 16 weldably attached adjacent end 78. Plate 14 also has the second support member 18 weldably attached to the end 80. The support members 16 and 18 are positioned on the top surface 82 of the plate 14. The cylindrical member 66 is fastened centrally between the end 78 and 80 of plate 14.

It can be seen, in particular in FIG. 2, that the spiralled surface 70 has both a relatively wide surface area as viewed from the top of Cylindrical member 66 and also a wide surface area as viewed from the side of cylindrical member 66. As such, the spiralled surface 70 provides resistance against side-to-side removal and against upward movement. The configuration of the spiralled surface 70 further enhances the resistance of the support structure 60 against removal.

The present invention achieves many advantages not found in prior art sign structures. In particular, the present invention offers a configuration that is easy for those of weak to moderate strength to install and remove from the ground. In order to install the sign frame 10 into the ground, it is only necessary to pierce the ground with the pointed end 30. This insertion should continue until the bottom edge of the spiralled surface 70 comes into contact with the ground. After the bottom edge of the spiralled surface 70 comes into contact with the ground, the sign frame 10 should be suitably rotated so as to cause the spiralled surface 70 to engage the ground and further cause the pointed end 30 to penetrate the earth. This rotation should continue until the bottom surface 74 of the plate 14 comes into abutment with the top of the ground. The shape of the triangular member 30 further enhances the ability of the spiralled surface 70 to penetrate the earth. The triangular member 30 acts as an auger so as to dig through the ground and to loosen the ground before the spiralled surface 70 encounters the earth.

Once the sign support frame 10 is positioned in abutment with the top of the earth, then the sign frame has been properly installed. Signs may be inserted into the receiving section for proper display.

It becomes very difficult to remove the sign without prior knowledge of the configuration of the support structure. The technique for removing the sign, in accordance with the prior art, has been to simply pull the sign from the ground. This removal technique is difficult given the wide surface area presented by the spiral surface 70 and the end surface 68 of the triangular member 30. It is also difficult to remove the sign by side-to-side movement since the plate 14 resists the movement and since the surface area of the spiralled surface 70 further resists the movement.

In order to remove the sign, it is only necessary to rotate the sign in the direction opposite the rotation of installation. This gently pulls the sign from the earth until the pointed end 30 can be lifted from the surface of the earth. The configuration of the spiralled surface 70 enhances the ability to remove the end surface 32 of triangular member 30.

The present invention preserves the life and appearance of the sign by eliminating the need to hammer the sign into the ground. Since dislodgment is difficult, the sign will retain its professional appearance.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

We claim:

1. A support frame for a sign comprising:

a cylindrical member having a generally pointed end, said cylindrical member having a triangular shaped member affixed to said cylindrical member, said triangular shaped member being said generally pointed end;

a flat plate affixed to an end of said cylindrical member opposite said pointed end;

a generally spiralled surface affixed to an exterior of said cylindrical member;

a first sign support member extending angularly upwardly and outwardly from the side of said plate opposite said cylindrical member, said first sign support member connected to an end of said plate; and a second sign support member extending angularly upwardly and outwardly from said said side of said plate, said second sign support member connected to an end of said plate opposite said first sign support member, said first and second sign support members extending outwardly in different directions.

2. The support frame of claim 1, said triangular shaped member having an end surface having a greater length than the diameter of said cylindrical member.

3. The support frame of claim 1, said plate extending perpendicularly to said cylindrical member, said cylindrical member affixed to a central location on the side of said plate opposite said first and second sign support members.

4. The support frame of claim 1, said spiralled surface positioned generally midway between said plate and said pointed end.

5. The support frame of claim 4, said spiralled surface extending for roughly five hundred and forty degrees around the exterior surface of said cylindrical member.

6. A sign frame comprising:

a ground insertion member having a generally pointed end, said ground insertion member having a spiralled surface thereon, said ground insertion member being a cylindrical member, said generally pointed end being a solid triangular member affixed to an end of said cylindrical member;

a plate affixed to an end of said ground insertion member opposite said pointed end;

a first sign support member extending angularly upwardly and outwardly from a side of said plate opposite said ground insertion member.

a second sign support member extending angularly upwardly and outwardly from said side of said plate; and a sign receiving means connected to said first and second sign support members, said sign receiving means for receiving a sign therein.

7. The sign frame of claim 6, said spiralled surface extending for roughly five hundred and forty degrees around an exterior surface of said cylindrical member.

8. The sign frame of claim 6, said triangular member having an end surface with a greater length than the diameter of said cylindrical member.

9. The sign frame of claim 6, said plate extending perpendicularly to said ground insertion member, said ground insertion member affixed to a central location of said plate.

10. The sign frame of claim 9, said first and second sign support members affixed to opposite ends of said plate, said first and second sign support members extending outwardly in opposite directions.

11. The sign frame of claim 10, said sign receiving means having a rectangular shape, said first and second sign support members forming sides of said rectangular shape, said rectangular shape having a slot therein for receiving a flat sign.

12. The sign frame of claim 11, said sign receiving means having a crossbar extending between and connected to said first and second sign support members, said crossbar arranged parallel to said plate.

13. The sign frame of claim 12, said crossbar having at least one bracket thereon, said bracket for supporting another sign below said crossbar.

14. An apparatus for supporting a sign structure above the ground comprising:

a rigid longitudinal member;

a triangular member affixed to one end of said longitudinal member, said triangular member having an end surface having a greater length than the diameter of said longitudinal member;

a spiralled surface affixed to an exterior surface of said longitudinal member, said spiralled surface having a diameter greater than the diameter of the end surface of said triangular member; and a plate affixed perpendicularly to an end of said rigid longitudinal member opposite said triangular member.

15. The apparatus of claim 14, said spiralled surface positioned midway between said plate and said triangular member, said spiralled surface extending for approximately five hundred and forty degrees around said longitudinal member.

16. The apparatus of claim 14, further comprising:

a first sign support member extending angularly upwardly and outwardly from a side of said plate opposite said longitudinal member; and a second sign support member extending angularly upwardly and outwardly from a side of said plate opposite said longitudinal member, said first and second sign support members affixed to opposite ends of said plate, said first and second sign support members extending outwardly in opposite directions.

* * * * *